US007641954B2

(12) United States Patent
Rouanet et al.

(10) Patent No.: US 7,641,954 B2
(45) Date of Patent: Jan. 5, 2010

(54) INSULATED PANEL AND GLAZING SYSTEM COMPRISING THE SAME

(75) Inventors: Stephane F. Rouanet, Westford, MA (US); James N. Litrun, Pepperell, MA (US)

(73) Assignee: Cabot Corporation, Boston, MA (US)

( * ) Notice: Subject to any disclaimer, the term of this patent is extended or adjusted under 35 U.S.C. 154(b) by 23 days.

(21) Appl. No.: 10/679,121

(22) Filed: Oct. 3, 2003

(65) Prior Publication Data

US 2005/0074566 A1 Apr. 7, 2005

(51) Int. Cl.
*B32B 3/02* (2006.01)
*E06B 3/24* (2006.01)
*E04C 2/54* (2006.01)

(52) U.S. Cl. ..... 428/76; 428/178; 428/72; 428/34; 52/204.595; 52/786.1; 52/793.1; 52/794.1

(58) Field of Classification Search ..... 428/34, 428/72, 76, 178, 188; 52/786.1, 786.13, 52/204.595, 793.1, 794.1; 181/286, 293, 181/288, 290
See application file for complete search history.

(56) References Cited

U.S. PATENT DOCUMENTS 3,741,857 A 6/1973 Kakutani et al.
3,953,110 A 4/1976 Charoudi ..... 350/161
4,114,597 A 9/1978 Erb ..... 126/271
4,443,987 A * 4/1984 Erb ..... 52/309.1
4,569,872 A 2/1986 Miller
4,954,327 A 9/1990 Blount ..... 423/338
5,027,574 A * 7/1991 Phillip ..... 52/171.3
5,098,790 A 3/1992 Diemunsch et al.
5,154,953 A 10/1992 de Moncuit et al.
5,156,895 A * 10/1992 Martin ..... 428/72
5,291,705 A 3/1994 Dickerson
5,294,472 A 3/1994 Arnold et al.
5,294,480 A 3/1994 Mielke et al.
5,381,149 A 1/1995 Dougherty et al. ..... 342/1

(Continued)

FOREIGN PATENT DOCUMENTS

DE 3927538(A1) 2/1991

(Continued)

OTHER PUBLICATIONS

Acoustic Properties of Microporous SiO2-Aerogel, M. Gronauer and J. Fricke, Acustica, vol. 59, (1986), 177-181.

(Continued)

*Primary Examiner*—Donald Loney

(57) ABSTRACT

The invention provides a translucent glazing panel comprising: (a) a thermoplastic panel comprising (i) an outer wall having an inner surface defining an internal channel, the internal channel having an internal volume, and (ii) at least one inner wall protruding from the inner surface into the internal channel, and (b) hydrophobic aerogel particles, the hydrophobic aerogel particles being disposed within the channel. The invention also provides an insulated glazing system comprising: (a) a first U-shaped element, (b) a second U-shaped element, the first and second elements being disposed to define a cavity therebetween, and (c) an insulating panel disposed within the cavity. The insulated glazing system can further comprise hydrophobic aerogel particles disposed within the internal channel of the insulating panel. The insulating panel of the glazing system also can be the same as the translucent glazing panel described herein.

58 Claims, 8 Drawing Sheets

U.S. PATENT DOCUMENTS

| | | | | |
|---|---|---|---|---|
| 5,394,786 | A | 3/1995 | Gettle et al. | 86/50 |
| 5,437,902 | A | 8/1995 | Itoh et al. | |
| 5,524,381 | A | 6/1996 | Chahroudi | |
| 5,550,338 | A | 8/1996 | Hielscher | 181/290 |
| 5,655,538 | A | 8/1997 | Lorraine et al. | 128/662.03 |
| 5,656,195 | A | 8/1997 | Mielke et al. | 252/62 |
| 5,748,758 | A | 5/1998 | Menasco, Jr. et al. | 381/176 |
| 5,786,059 | A | 7/1998 | Frank et al. | 442/68 |
| 5,923,819 | A | 7/1999 | Ross et al. | |
| 5,948,314 | A | 9/1999 | Geiss et al. | 252/62 |
| 5,968,618 | A | 10/1999 | Miller | |
| 6,012,449 | A | 1/2000 | Schulz | |
| 6,088,978 | A | 7/2000 | Satterwhite | |
| 6,316,092 | B1 | 11/2001 | Frank et al. | |
| 6,370,838 | B1 | 4/2002 | Evason et al. | |
| 6,598,358 | B1 | 7/2003 | Schwertfeger et al. | 52/145 |
| 6,677,034 | B1 | 1/2004 | Hooley et al. | 428/323 |
| 2005/0048231 | A1 | 3/2005 | Morphet | 428/34 |

FOREIGN PATENT DOCUMENTS

| | | | |
|---|---|---|---|
| DE | 299 17 402 | | 5/2000 |
| EP | 0018955 | | 4/1980 |
| EP | 0 111 408 | A1 | 6/1984 |
| EP | 0 171 722 | B1 | 8/1985 |
| EP | 0 340 707 | B1 | 4/1989 |
| EP | 0 839 253 | B1 | 3/1996 |
| EP | 0 742 324 | A1 | 11/1996 |
| GB | 1098681 | | 1/1968 |
| GB | 2 061 354 | A | 5/1981 |
| GB | 2241468 | A | 3/1990 |
| GB | 2 247 040 | | 2/1992 |
| GB | 2 406 353 | | 3/2005 |
| WO | WO97/38351 | | 10/1997 |
| WO | WO 98/07780 | | 2/1998 |

OTHER PUBLICATIONS

Acoustic Properties and Potential Applications of Silica Aerogels, V. Gibiat et al. / Journal of Non-Crystaline Solids 186 (1995) 244-255.
Sound Propagation in $SiO_2$ Aerogels, J. Gross et al., J. Acoust. Soc. Am., vol. 91, No. 4, Pt. 1, Apr. 1992, 2004-2006.
A Theoretical Study of Sound Transmission Through Aerogel Glazing Systems, P.P. Narang, Applied Acoustics 34 (1991) 249-259.
Glazings with Granular Aerogel, Jorg J. Dengler and Volker Wittwer. Final Report Contract JOUE-CT90-0057, Dec. 15, 1993.
Glazings with Granular Aerogel, Jorg J. Dengler and Volker Wittwer, SPIE vol. 2255, 718-727.
"Use of Surface Treated Aerogels Derived from Various Silica Precursors in Translucent Insulation Panels", W.C. Ackerman, M. Vlachos, S Rouanet, and J. Fruendt, Journal of Non-Crystalline Solids, 285, (2001), 264-271.

* cited by examiner

INSULATED PANEL AND GLAZING SYSTEM COMPRISING THE SAME

FIELD OF THE INVENTION

This invention pertains to insulated panels and glazing systems comprising the same.

BACKGROUND OF THE INVENTION

In an effort to improve indoor lighting conditions and the aesthetic appeal of enclosed spaces, architects and builders have begun to construct buildings using an increasing large amount of glazing materials and systems, such as windows, skylights, and transparent or translucent walls and roofs. While the use of such glazing materials can dramatically improve the quality of indoor lighting, buildings incorporating relatively large amounts of such glazing materials often are poorly insulated. More specifically, the thermal transmission of conventional glazing materials typically is significantly higher than the thermal transmission of conventional building materials or structures, such as framed roofs and walls. Therefore, the overall thermal transmission of a building incorporating relatively large amounts of such glazing materials typically is significantly higher than a similar structure using less of the same, and such buildings often experience relatively large amounts of heat flux across the glazing materials, which can dramatically increase the cost of maintaining the climate within the building at a level considered comfortable by the occupants. Accordingly, several attempts have been made to address the relatively poor (i.e., high) thermal transmission of conventional glazing materials and systems.

For example, glazing materials and systems, such as windows, have been developed which incorporate an air space between two vitreous (e.g., glass) or thermoplastic surfaces. One such popular glazing material is commonly referred to as a "multiwall panel." These multiwall panels typically comprise two thermoplastic sheets and a plurality of supporting members disposed between the thermoplastic sheets. The thermoplastic sheets and the supporting members together define a plurality of chambers disposed between the thermoplastic sheets and the supporting members. Insofar as gases have lower thermal conductivities than solid materials, such as glass and thermoplastics, the gases within the chamber provide an insulating layer that serves to decrease and/or retard thermal transmission across the panel. While such multiwall panels do exhibit improved (i.e., lower) thermal transmission than conventional, single-pane glazing materials, condensation often forms within the chambers as the panels are exposed to differences in temperature and/or humidity across the major surfaces of the panel. The humid environment provided by such condensation can promote the growth of mold and mildew within the chambers of the panel. Furthermore, the structure of the multiwall panels often causes the panel to unevenly refract visible light, which can negatively impact the indoor lighting quality of a structure incorporating the panels as a glazing material.

Another glazing system that has been developed to provide an improved (i.e., lower) thermal transmission relative to conventional glazing materials and systems is commonly referred to as double-glazed U-profile or U-channel glass. These glazing systems typically comprise a pair of U-shaped glass elements disposed in such a way as to form a chamber between the two elements. While the gases contained within this channel can retard thermal transmission across the glazing system (i.e., between the two glass elements), the glazing system typically further comprises an insulating material disposed within the chamber formed between the two elements. The most commonly used insulating material is a rigid panel which consists of a plurality of acrylic (e.g., poly(methyl methacrylate)) capillaries covered by two glass fiber mats. The individual acrylic capillaries are arranged in a substantially parallel direction so that the panel resembles a honeycomb structure, the ends of which are covered by the glass fiber mats. These rigid insulation panels can often dramatically improve (i.e., lower) the thermal transmission of a glazing system incorporating the same.

However, the costs saved due to the improved thermal transmission of the glazing system can often be partially offset by the relatively high labor costs associated with the installation of such insulating panels. For instance, the insulating panels are extremely fragile and frequently break during the installation due to their relatively large dimensions (e.g., up to about 6 meters or more in length). The debris generated by such breakage (e.g., glass fibers) can create an environmental hazard for the workers installing the insulating panels and must be painstakingly removed. Furthermore, the insulating panels typically are adhered to one of the glass elements (e.g., the glass element facing the outside of the building) before the other glass element is installed. In such a configuration, the insulating panel impedes the drainage of condensation that forms on the glass element to which the panel is adhered. As noted above, the humid environment provided by such condensation can then promote the growth of mold and mildew within the chamber formed by the glass elements.

A need therefore exits for an insulated panel that is suitable for use as a glazing material and a glazing system comprising such an insulated panel, both of which address the foregoing and other problems associated with existing insulated glazing materials and systems. The invention provides such an insulated panel and glazing system. These and other advantages of the invention, as well as additional inventive features, will be apparent from the description of the invention provided herein.

BRIEF SUMMARY OF THE INVENTION

The invention provides a glazing panel, preferably translucent, comprising: (a) a thermoplastic panel comprising (i) an outer wall having an inner surface defining an internal channel, the internal channel having an internal volume, and (ii) at least one inner wall protruding from the inner surface into the internal channel, and (b) hydrophobic aerogel particles, the hydrophobic aerogel particles being disposed within the channel.

The invention further provides a glazing panel, preferably translucent, comprising: (a) a thermoplastic panel comprising (i) a first thermoplastic sheet, (ii) a second thermoplastic sheet, and (iii) two or more supporting members, the supporting members being disposed between the first and second thermoplastic sheets, and the supporting members defining at least one channel disposed between the first and second thermoplastic sheets, the channel having an internal volume, and (b) hydrophobic aerogel particles, the hydrophobic aerogel particles being disposed within the channel.

The invention also provides an insulated glazing system comprising: (a) a first element, preferably a U-shaped glass element comprising a base from which at least two legs extend, (b) a second element, preferably a U-shaped glass element comprising a base from which at least two legs extend, the first and second elements being disposed to define a cavity therebetween, (c) an insulating panel disposed within the cavity, the insulating panel comprising an outer wall defining an internal channel, the internal channel having an internal volume, and (d) hydrophobic aerogel particles, the hydrophobic aerogel particles being disposed within the internal channel.

The invention additionally provides an insulated glazing system comprising: (a) a first element, preferably a U-shaped glass element comprising a base from which at least two legs extend, (b) a second element, preferably a U-shaped glass element comprising a base from which at least two legs extend, the first and second elements being disposed to define a cavity therebetween, and (c) an insulating panel disposed within the cavity, the insulating panel comprising (i) an outer wall having an inner surface defining an internal channel, the internal channel having an internal volume, and (ii) at least one inner wall protruding from the inner surface into the internal channel, the outer wall and inner wall being unitarily formed of a thermoplastic resin.

The invention provides an insulated glazing system comprising: (a) a first element, preferably a U-shaped glass element comprising a base from which at least two legs extend, (b) a second element, preferably a U-shaped glass element comprising a base from which at least two legs extend, the first and second elements being disposed to define a cavity therebetween, and (c) an insulating panel disposed within the cavity, the insulating panel comprising (i) a first thermoplastic sheet, (ii) a second thermoplastic sheet, the first and second thermoplastic sheets being substantially parallel to each other, and (iii) at least two supporting members, the supporting members being disposed between the first and second thermoplastic sheets, and the supporting members defining at least one channel disposed between the first and second thermoplastic sheets.

DETAILED DESCRIPTION OF THE INVENTION

Figure 1:
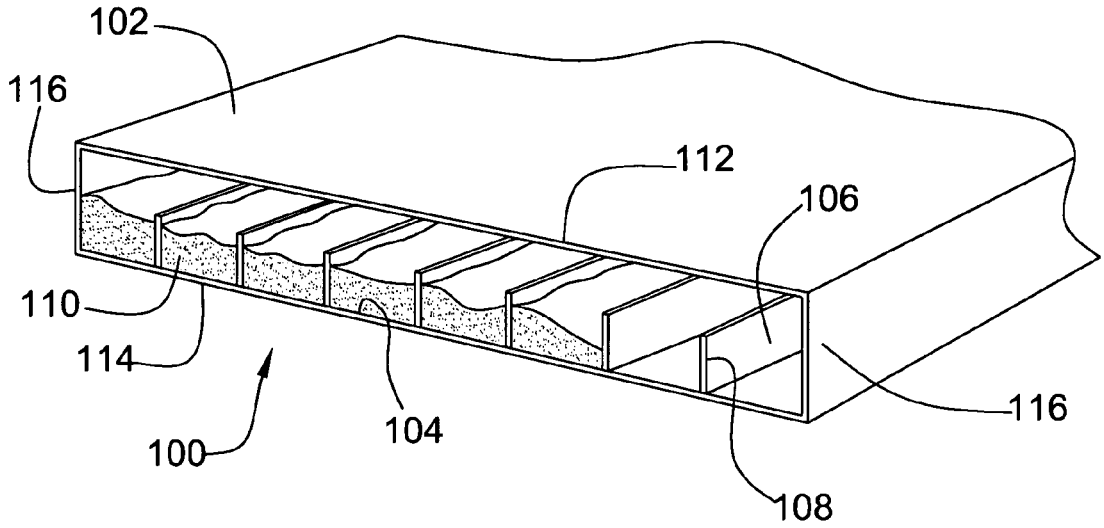
FIG. 1 is a perspective sectional view of an insulating panel according to teachings of the invention comprising an outer wall defining an internal channel and at least one inner wall protruding into the inner channel.

Turning now to the drawings, there is shown in FIG. 1, a glazing panel 100 constructed in accordance with teachings of the invention. The glazing panel 100 has a length and comprises an outer wall 102 having an inner surface 104. The outer wall 102 defines an internal channel 106.

In accordance with the invention, and in order to maximize the insulating, light-transmitting, and moisture-resistant properties of the glazing panel, the panel 100 is preferably transparent or translucent and comprises hydrophobic aerogel particles 110 disposed within the internal channel. For the purposes of this disclosure, the term translucent will be used to describe both transparent and translucent materials and structures. While not wishing to be bound to any particular theory, it is believed that the relatively large internal volume of the hydrophobic aerogel particles provides an insulating layer in the glazing panel, thereby decreasing the thermal transmission (i.e., U-value) of a glazing panel according to the invention. Furthermore, it is believed that the aggregate light scattering properties of a collection of the hydrophobic aerogel particles (e.g., the particle contained within the channel or any part thereof) contributes to the diffusion of visible light transmitted through the panel, thereby improving the quality of transmitted light that passes through the panel and improving the internal lighting of any structure utilizing the same as a glazing material (e.g., a window, skylight, or structural glazing element). Lastly, it is believed that the hydrophobic nature of the hydrophobic areogel particles prevents, at least in part, the formation of condensation on the internal surfaces of a translucent glazing panel according to the invention as the glazing panel is exposed to differences in temperature and/or humidity across the major surfaces of the glazing panel (e.g., across the interior surface and exterior surface of a window incorporating a translucent glazing panel according to the invention).

The hydrophobic aerogel particles contained in a glazing panel according to the invention can be any suitable hydrophobic aerogel particles. The hydrophobic aerogel particles can comprise organic aerogel particles, inorganic aerogel particles (e.g., metal oxide aerogel particles), or a mixture thereof. When the hydrophobic aerogel particles comprise organic aerogel particles, the organic aerogel particles preferably are selected from the group consisting of resorcinol-formaldehyde aerogel particles, melamine-formaldehyde aerogel particles, and combinations thereof. When the hydrophobic aerogel particles comprise inorganic aerogel particles, the inorganic aerogel particles preferably are metal oxide aerogel particles selected from the group consisting of silica aerogel particles, titania aerogel particles, alumina aerogel particles, and combinations thereof. Most preferably, the hydrophobic aerogel particles are silica aerogel particles.

In order to further control placement and distribution of the aerogel particles within the internal channel 106, the panel 100 preferably further includes one or more inner walls 108, as shown in FIG. 1. The inner wall 108 protrudes into the internal channel 106 from the inner surface 104 of the outer wall 102 to at least partially divide the internal channel 106. In this way, the aerogel particles 110 are disposed within and fill at least a portion of the internal channel 106 formed by the outer wall 102. In the currently preferred embodiment, substantially all of the internal volume of the internal channel 106 is filled with hydrophobic aerogel particles 110.

Preferably, the panel 100 comprises a plurality of inner walls 108 (e.g., two or more internal walls) protruding from the inner surface 104 of the outer wall 102. When the translucent glazing panel 100 comprises a plurality of inner walls 108, the inner walls 108 can be provided in any suitable configuration. For example, in FIG. 1, the inner walls 108 are disposed adjacent one another, protruding from a single section of the inner wall 108. Conversely, in FIG. 2, a plurality of inner walls 208 protrude from opposing portions of the inner surface 204 of the outer wall 202. (As a general matter, similar reference numerals will be utilized in the various illustrated embodiments of the invention.)

Figure 3:
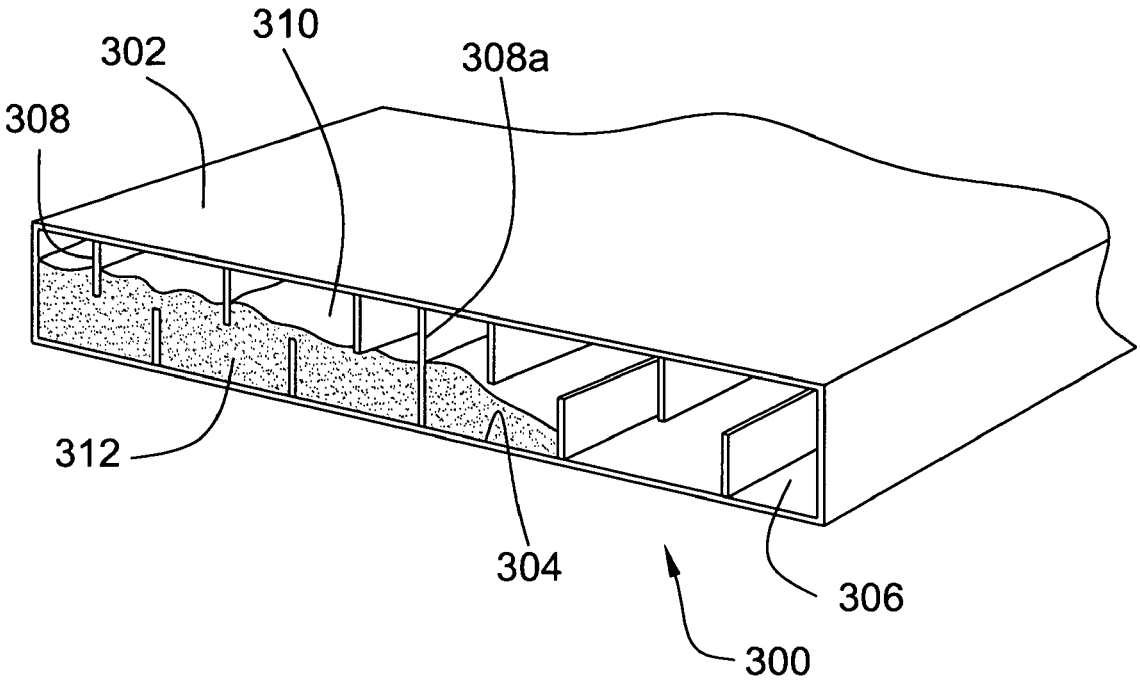
FIG. 3 is a perspective sectional view of an insulating panel according to teachings of the invention comprising an outer wall defining an internal channel and at least one inner wall protruding into the internal channel and contacting the inner surface of the outer wall at at least two distinct points.

In order to further control the distribution of the aerogel particles 110 within the internal channel 106, 206, the volume of the internal channel 106, 206 may be further divided into a plurality of channels. As shown in FIG. 3, the inner wall 308*a* of the panel 300 can intersect the inner surface 304 of the outer wall 302 at at least two distinct points. The panel 300 can include one such wall 308*a*, as shown in FIG. 3, so that the outer wall 302 and inner wall 308*a* define two internal channels 306, 310 having internal volumes. It will be appreciated by those of skill in the art that the inner wall 308*a* may extend substantially the entire length of the panel 300 or extend only a portion of the length. Thus, where the inner wall 308*a* extends along at least a portion of the length, the outer wall 302 and inner wall 308*a* define first and second internal channels 306, 310. Further, the inner wall 308*a* may have any cross-sectional configuration. For example, it may be curved, or it may include an angular portion, or it may be formed from, in essence, the engagement of two inner walls (such as 308) that intersect the inner surface 304 at only one point. The inner walls may also intersect the inner surface 304 at three or more points.

Figure 2:
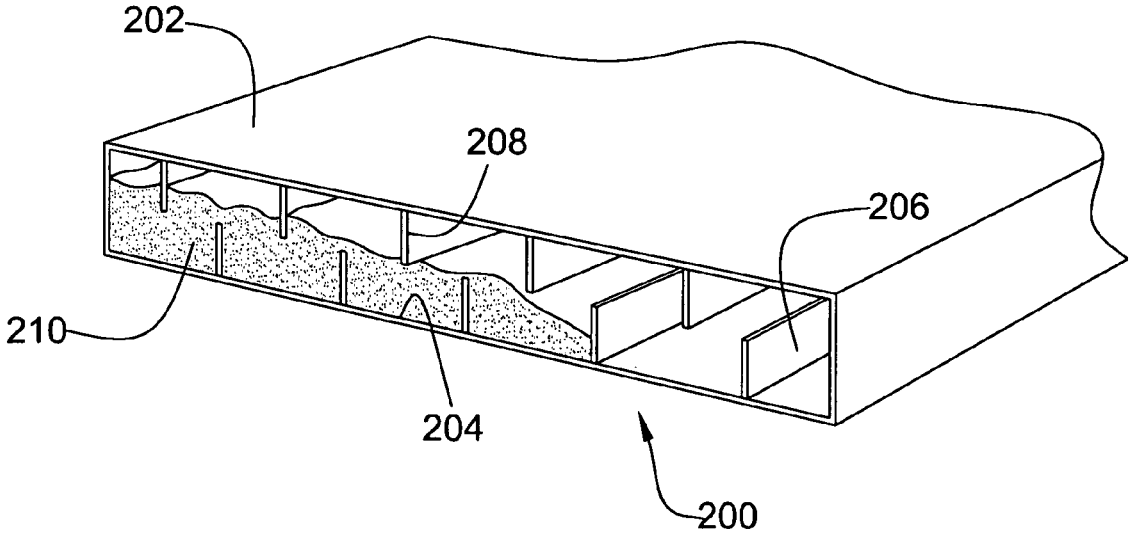
FIG. 2 is a perspective sectional view of another insulating panel according to teachings of the invention comprising an outer wall defining an internal channel and a plurality of inner walls protruding into the inner channel from opposing portions of the inner surface of the outer wall.

The panel 300 may likewise include one or more inner walls 308 that protrude from the inner surface 304 of the outer wall 302, but do not intersect the inner surface 304 of the outer wall 302 at at least two distinct points, such as walls 108 and 208 in FIGS. 1 and 2. Hydrophobic aerogel particles 312 are disposed within at least one of the internal channels 306, 310, preferably, filling at least a portion of the internal volume of both of the internal channels 306, 310. In a currently preferred embodiment, substantially all of the internal volume of the internal channels 306, 310 is filled with hydrophobic aerogel particles 312. While the inner wall 308*a* prevents or inhibits movement of the particles 312 between the channels 306, 310, the inner walls 308 further control the location of the aerogel particles 312, but do not necessarily prevent particle 312 movement within a given channel 306, 310 in and of themselves.

It will thus be appreciated by those of skill in the art, that the internal configuration of the panel 300 may include a plurality of such inner walls 308*a* that intersect the inner surface 304 to create a plurality of such channels 306, 310, with or without such inner walls 308 that intersect the inner surface 304 at only one position. For example, the panel 400, 500 may include a plurality of inner walls 406, 506, 512 that intersect the internal surface of the outer wall at two or more points, as shown in FIGS. 4 and 5, respectively.

Figure 4:
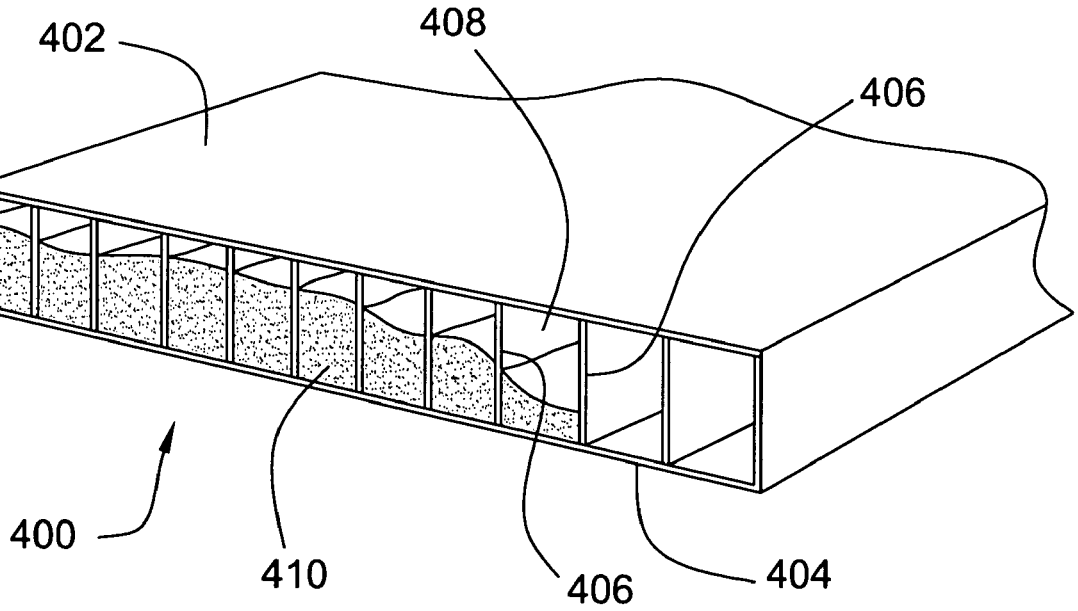
FIG. 4 is a perspective sectional view of an insulating panel according to teachings of the invention comprising a first thermoplastic sheet, a second thermoplastic sheet, and two or more supporting members disposed between the first and second thermoplastic sheets to define at least one channel disposed between the first and second thermoplastic sheets.

More specifically, as depicted in FIG. 4, for example, the translucent glazing panel comprises a first thermoplastic sheet 402, a second thermoplastic sheet 404, and two or more supporting members 406 disposed between the first and second thermoplastic sheets 402, 404. The first thermoplastic sheet 402 preferably is substantially parallel to the second thermoplastic sheet 404. The supporting members 406 define at least one channel 408 disposed between the first and second thermoplastic sheets 402, 404. As with the other embodiments, the glazing panel further comprises hydrophobic aerogel particles 410 disposed within at least one, and preferably at least a portion of or all, of the channels 408 defined by the supporting members 406.

Figure 5:
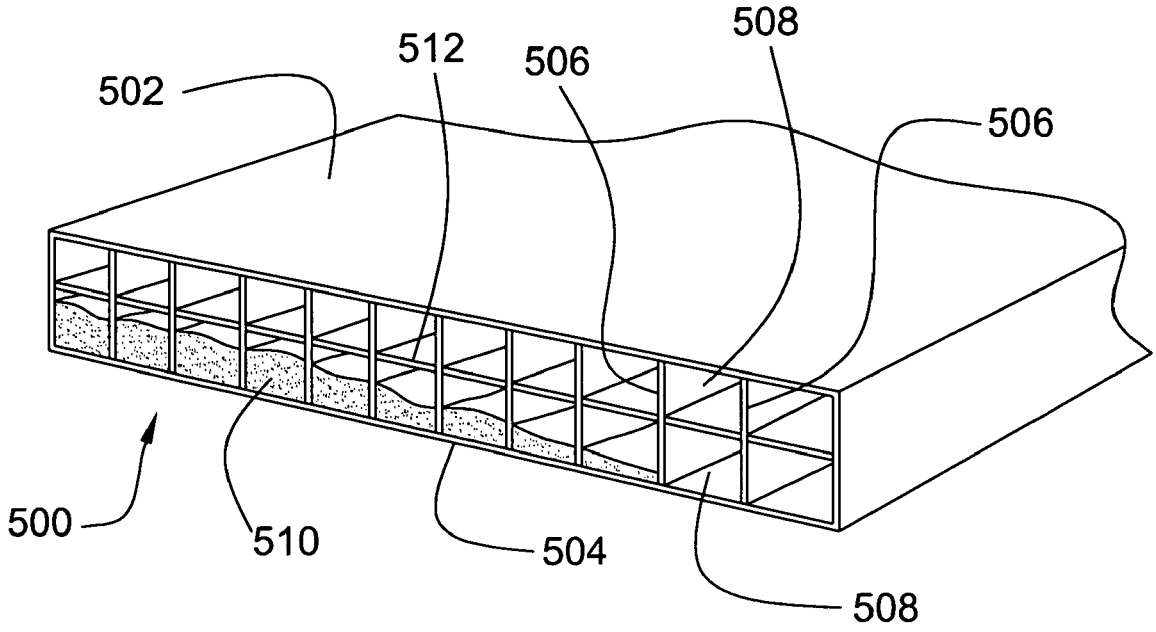
FIG. 5 is a perspective sectional view of an insulating panel similar to the panel depicted in FIG. 4 in which a third thermoplastic sheet is disposed between the first and second thermoplastic sheets.
Figure 6:
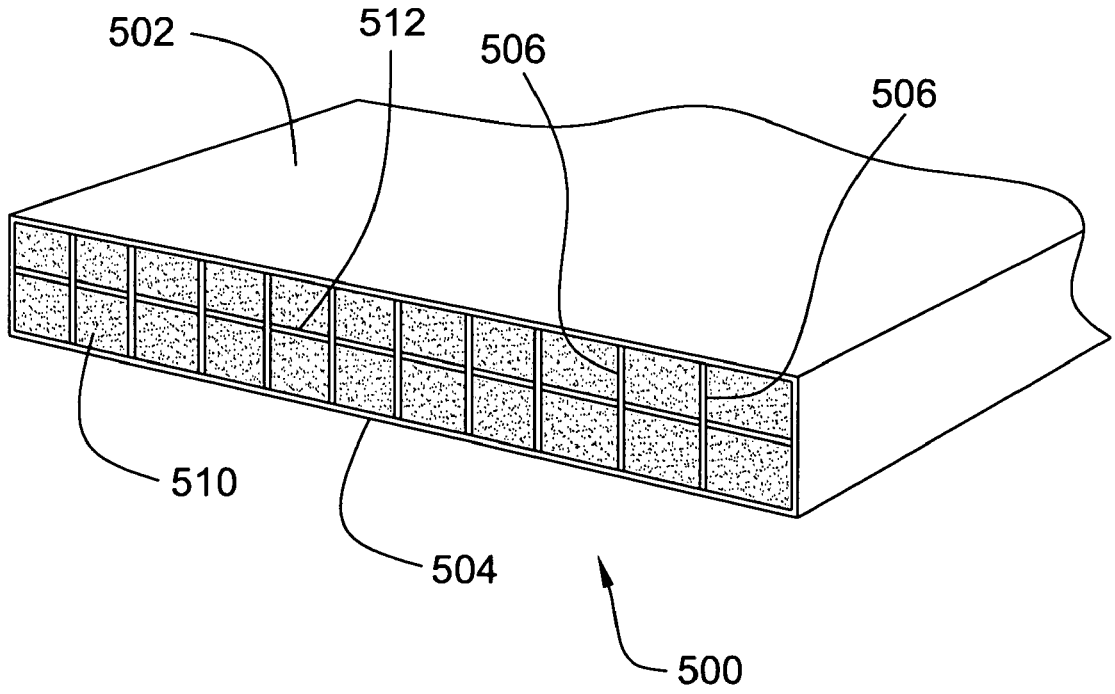
FIG. 6 is a perspective sectional view of an insulating panel similar to the panel depicted in FIG. 5 in which substantially all of the internal volume of the channels is filled with hydrophobic aerogel particles.

As depicted in FIG. 5, the thermoplastic panel 500 can further comprise a third thermoplastic sheet 512 disposed between the first thermoplastic sheet 502 and the second thermoplastic sheet 504, the third thermoplastic sheet 512 and the supporting members 506 defining at least two rows of channels 508 disposed between the first and second thermoplastic sheets 502, 504. As shown in FIG. 5, preferably, the third thermoplastic sheet 512 is substantially parallel to the first and second thermoplastic sheets 502, 504. The hydrophobic aerogel particles 510 are disposed within at least one, and preferably a portion of or all, of the channels 508 formed by the third thermoplastic sheet 512 and the supporting members 506. Most preferably, as depicted in FIG. 6, substantially all of the internal volume of each of the channels 508 defined by the first, second, and third thermoplastic sheets 502, 504, 512 and the supporting members 506 are filled with hydrophobic aerogel particles 510.

The outer wall and inner wall(s) of the glazing panel can be formed using any suitable method, with any suitable material. Referring to FIG. 1, for example, the outer wall 102 and inner walls 108 can be unitarily formed of a thermoplastic resin using thermoplastic molding methods known in the art (e.g., injection molding, extrusion molding, etc.). Alternatively, the glazing panel can include separately formed components that are later assembled. For example, the outer wall 102 can comprise, for example, a first thermoplastic sheet 112, a second thermoplastic sheet 114, and at least two supporting members 116 disposed between the first and second thermoplastic sheets 112, 114 to form the outer wall 102. In such an embodiment, the first thermoplastic sheet 112, second thermoplastic sheet 114, supporting members 116, and internal walls 108 may be joined using an adhesive, sonic welding, or any other method suitable for joining two or more articles comprising the material of the walls.

Similar fabrication methods may be utilized with the other embodiments. For example, in the embodiment of FIG. 4, the entire panel 400 may be injection molded or extruded. Alternately, the first thermoplastic sheet 402, second thermoplastic sheet 404, and supporting members 406 of the glazing panel 400 can be formed using any suitable method, and then joined using an adhesive, sonic welding, or any other method suitable for joining two or more articles comprising the material of the walls.

A thermoplastic panel preferably comprises any suitable thermoplastic resin. Suitable thermoplastic resins preferably exhibit a relatively high mechanical strength and can withstand large temperature gradients. The thermoplastic of the panel preferably comprises a thermoplastic resin selected from the group consisting of polycarbonate, polyethylene, poly(methyl methacrylate), poly(vinyl chloride), and mixtures thereof. Most preferably, the thermoplastic of the panel comprises polycarbonate.

The glazing panel of the invention can be provided in any suitable size and/or shape. Typically, the glazing panel can be used to replace the vitreous glazing material (e.g., glass) used in conventional glazing systems (e.g., windows, skylights, etc.). Accordingly, a glazing panel according to the invention generally has a thickness of less than about 100 mm. When the glazing panel comprises an outer wall and at least one inner wall protruding from the surface thereof, as depicted in FIG. 1, the opposing surfaces of the outer wall 102 forming the thickness of the glazing panel 100 typically are separated by less than about 100 mm, preferably less than about 50 mm, and more preferably less than about 30 mm. Alternatively, when the glazing panel comprises a first thermoplastic sheet and a second thermoplastic sheet, as depicted in FIG. 4, for example, the first thermoplastic sheet 402 and the second thermoplastic sheet 404 typically are separated by less than about 1 cm, preferably less than about 50 mm, and more preferably less than about 30 mm.

The quality of visible light transmitted through a glazing panel according to the invention preferably is more diffuse than the visible light transmitted through similar glazing panels that are not filled with hydrophobic aerogel particles. In particular, a glazing panel according to the invention preferably exhibits an improved haze value (e.g., a higher haze value) than a similar glazing panel that is not filled with hydrophobic aerogel particles. The haze value is a measurement of light-transmitting and wide-angle-light-scattering properties of planar sections of materials, such as glazing materials (e.g., transparent or translucent plastics). The haze value is defined in ASTM Standard D1003, entitled "Standard Test Method for Haze and Luminous Transmittance of Transparent Plastics," and can be measured in accordance with the procedures set forth therein. As utilized herein, the term "haze value" refers to the haze value of a glazing panel as defined and measured in accordance with ASTM Standard D1003. Preferably, a thermoplastic glazing panel according to the invention has a haze value of about 50% or more, more preferably about 75% or more.

Figure 7:
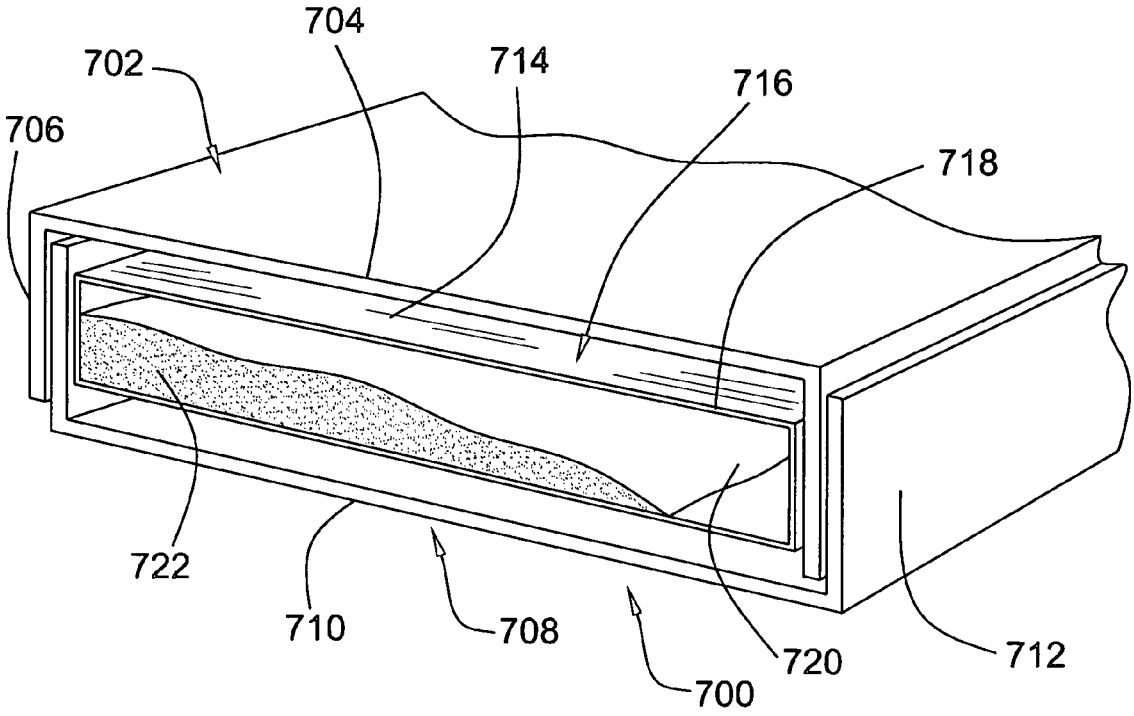
FIG. 7 is a perspective sectional view of an insulated glazing system according to teachings of the invention comprising a first U-shaped element, a second U-shaped element, and an insulating panel disposed within the cavity formed by the elements.

In accordance with another aspect of the invention, the inventive glazing panels, as shown for example in FIGS. 1–6, may be incorporated into a so-called U-channel glass glazing system or other appropriate glazing system. Turning now to FIG. 7, the insulated glazing system 700 comprises elements 702, 708 that define a cavity 714 there between. In the illustrated embodiment, a pair of elongated, U-shaped glass elements 702, 708 are provided. The first U-shaped glass element 702 comprises a base 704 from which at least two legs 706 extend, and the second U-shaped element 708 comprises a base 710 from which at least two legs 712 extend. It will be appreciated that the elements 702, 708 could have an alternately structure. For example, they could each have an "L-shaped" structure, or one could have a "U-shaped" structure and the other an elongated flat structure which covers the internal channel of the U-shaped structure to form an elongated cavity therebetween. Thus, the invention is not limited to the inclusion of such U-shaped glass elements and the following explanation of structures utilizing such U-shaped glass elements is equally applicable to elongated elements of an alternate shape or cross-section.

In assembly, the first and second glass elements 702, 708 are disposed to define a cavity 714 therebetween. While the legs 706, 712 of the U-shaped glass elements 702, 708 are disposed in a staggered arrangement in the embodiment of FIG. 7, it will be appreciated that the first and second glass elements 702, 704 can be arranged in any suitable manner to define the cavity. For example, the legs of the first glass element can be disposed adjacent to the base of the second glass element, thereby defining a cavity bounded by the base and legs of the first glass element and the base of the second glass element. Alternatively, the ends of the legs of the first and second glass elements can be disposed adjacent to each other, thereby defining a cavity bounded by the base and legs of the first and second glass elements. The alternate possible cross-sectional shaped glass element structures may be similarly disposed in various manners to define the cavity.

Figure 8:
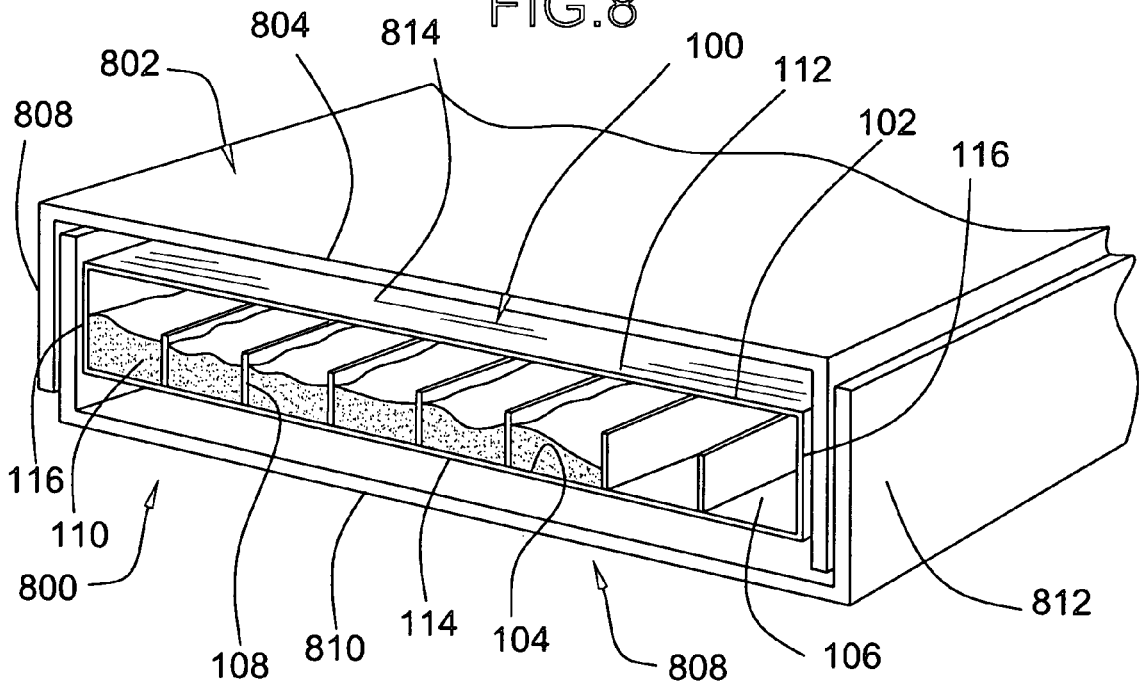
FIG. 8 is a perspective sectional view of an insulated glazing system similar to the system depicted in FIG. 7 in which the insulating panel further comprises at least one inner wall protruding into the internal channel of the insulating panel.
Figure 9:
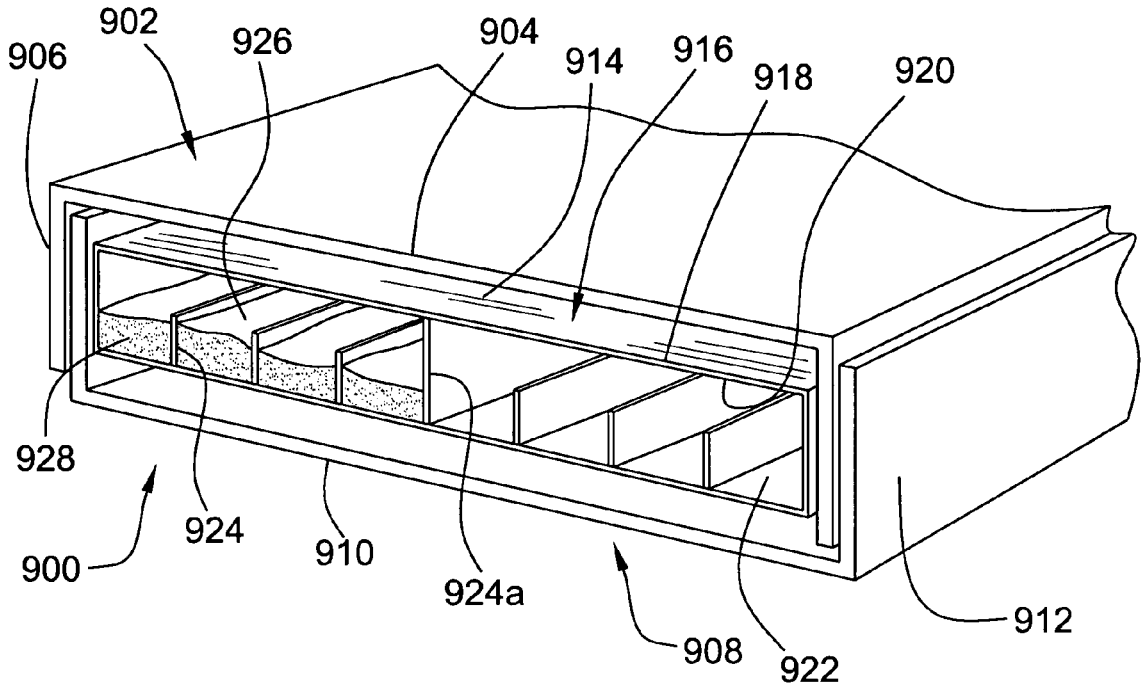
FIG. 9 is a perspective sectional view of an insulated glazing system similar to the system depicted in FIG. 8 in which at least one of the inner walls intersect the inner surface of the outer wall at at least two distinct points.
Figure 10:
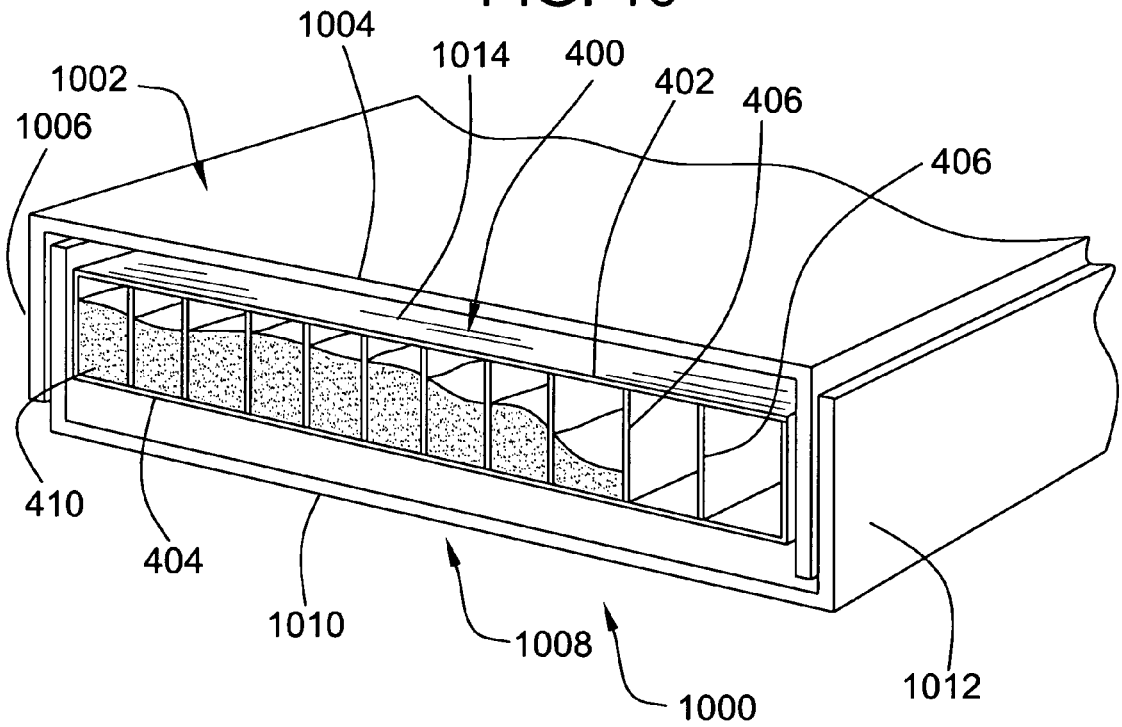
FIG. 10 is a perspective sectional view of an insulated glazing system according to teachings of the invention comprising a first element, a second element, and an insulating panel disposed within the cavity formed by the elements, the insulating panel comprising a first thermoplastic sheet, a second thermoplastic sheet, and at least two supporting members disposed between the first and second thermoplastic sheets to define at least one channel disposed between the first and second thermoplastic sheets.
Figure 11:
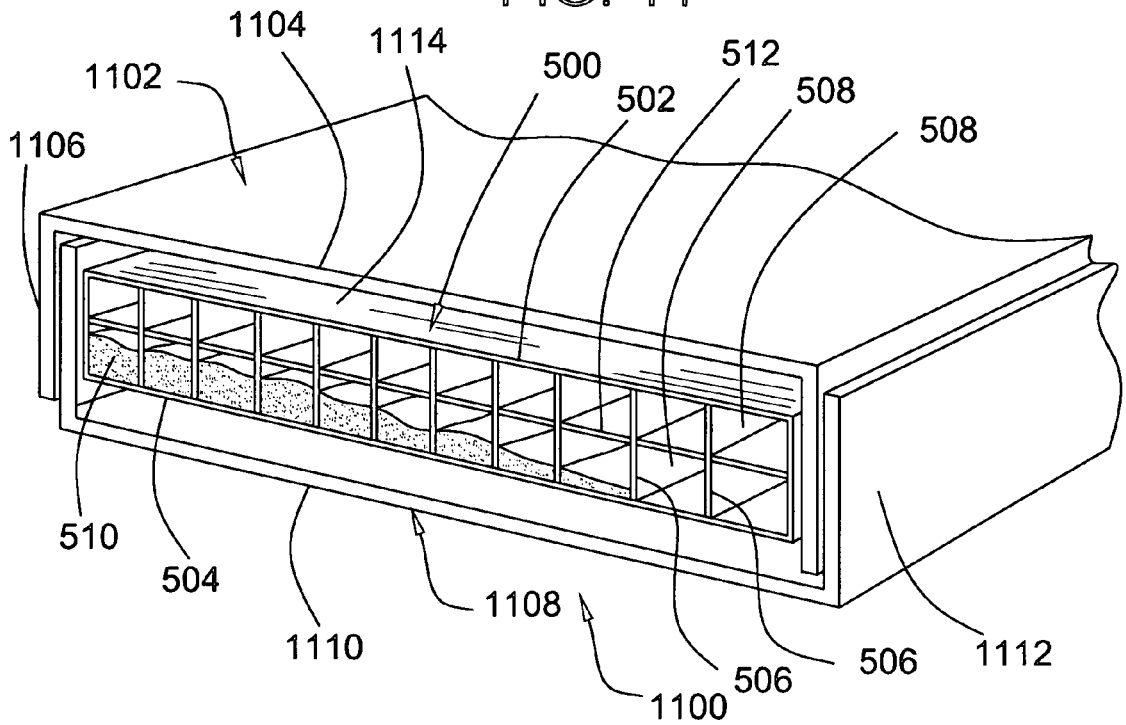
FIG. 11 is a perspective sectional view of an insulated glazing system similar to the system depicted in FIG. 10 in which the insulating panel further comprises a third thermoplastic sheet disposed between the first and second thermoplastic sheets.

The glazing system 700 according to teachings of the invention further comprises an insulating panel 716 disposed within the cavity 714 formed by the first and second glass elements 702, 708. The insulating panel of a glazing system according to the invention can have any suitable dimension. As disclosed above, the insulating panel 716 comprises an outer wall 718 defining an internal channel 720 that preferably comprises hydrophobic aerogel particles 722. Typically, at least a portion, and preferably substantially all, of the internal volume of the internal channel 720 is filled with hydrophobic aerogel particles 722. The structure of the insulating panel itself may be of any appropriate design. By way of example only, the structure of the insulating panel 100 of FIG. 1 may be included in the glazing system 800, as shown in FIG. 8; the insulating panel 400 of FIG. 4 may be included in the glazing system 1000 of FIG. 10; or the insulating panel 500 of FIG. 5 may be included in the glazing system 1100 of FIG. 11. It will be appreciated, however, that the insulating panel 916 may have an alternate design, such as is disclosed, for example in FIG. 9.

Figure 12:
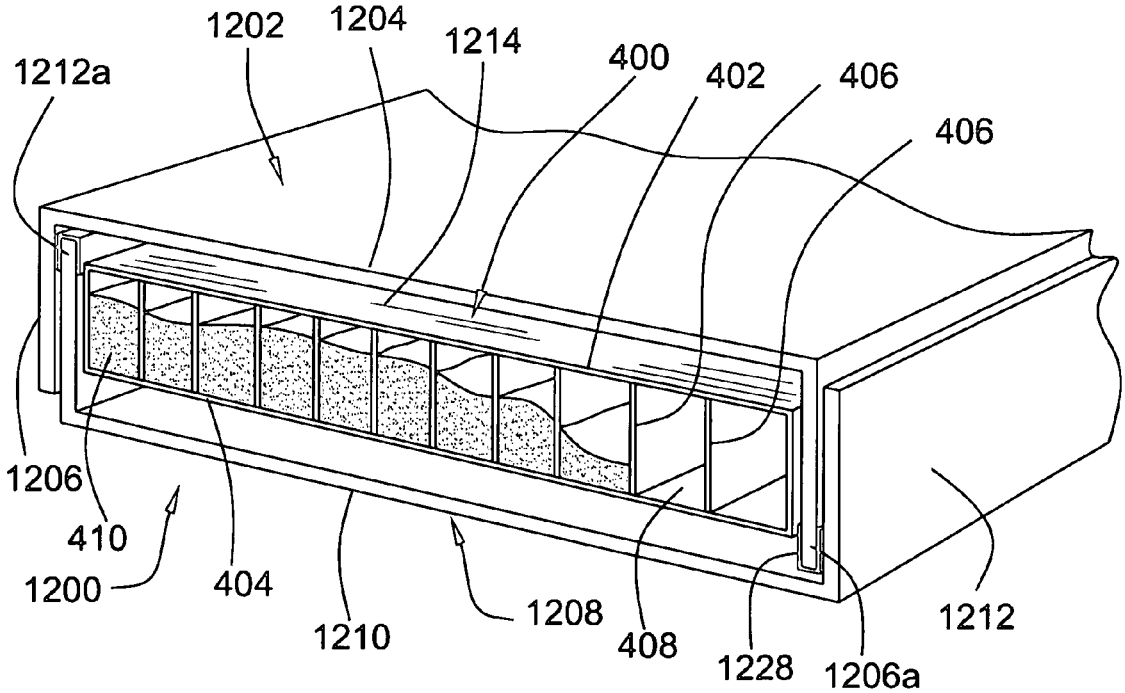
FIG. 12 is a perspective sectional view of an insulated glazing system similar to the system depicted in FIG. 10 in which the glazing system further comprises a sealant disposed between the elements.

Turning now to FIG. 12, in assembly, the first and second glass elements 1202, 1208 are disposed to form the cavity 1214 therebetween. The first and second glass elements 1202, 1208 of this embodiment are U-shaped and include legs 1206, 1212 extending from bases 1204, 1210, respectively. In order to reduce thermal transmission between the first and second glass elements 1202, 1208, an insulated glazing system according to the invention preferably comprises at least one sealant 1228 disposed between at least a portion of adjacent sections of the first and second glass elements 1202, 1208. As depicted in FIG. 12, the sealant 1228 typically is disposed to surround the distal tips 1206*a*, 1212*a* of the internally disposed legs 1206, 1212 of first and second U-shaped glass elements 1202, 1208. In this way, the sealant 1228 provides a seal not only between adjacently disposed legs, 1206, 1212, but also between the distal tips 1206*a*, 1212*a* of the internally disposed legs 1206, 1212 and the bases 1206, 1212. It will be appreciated, however, that the sealant 1228 can be alternately disposed.

Figure 13:
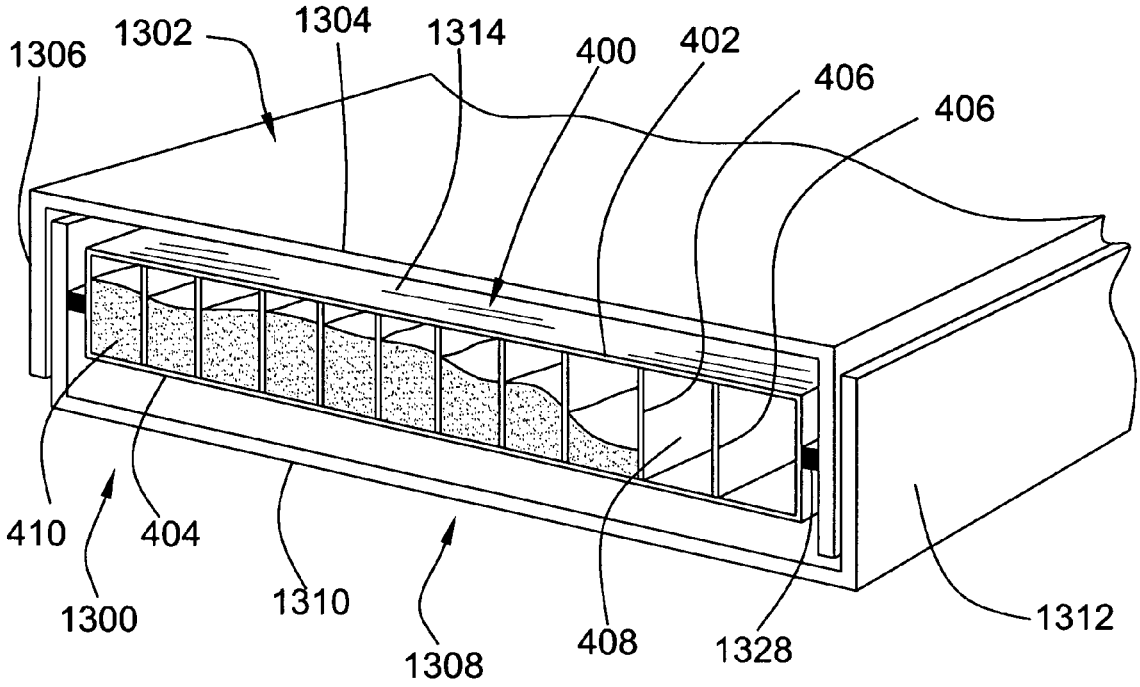
FIG. 13 is a perspective sectional view of an insulated glazing system similar to the system depicted in FIG. 10 in which a sealant is attached to the perimeter of the insulating panel.

Furthermore, in order to minimize or prevent thermal conduction between the insulating panel and the first and second glass elements, a sealant can be attached to at least a portion of the perimeter of the insulating panel. As depicted in FIG. 13, the sealant 1328 can be attached to the perimeter of the insulating panel 400, thereby separating and isolating the insulating panel 400 from the adjacent legs 1306, 1312 of the first and second glass elements 1302, 1308.

Figure 14:
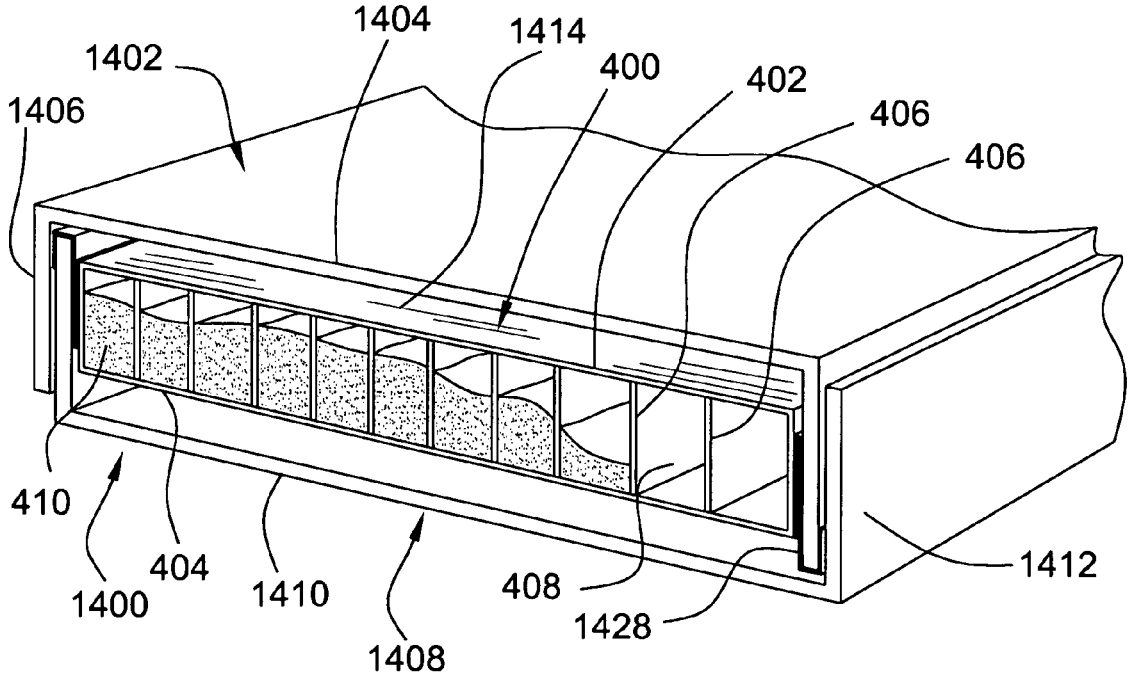
FIG. 14 is a perspective sectional view of an insulated glazing system similar to the system depicted in FIG. 10 in which the sealant is attached to the perimeter of the insulating panel, and the sealant also is disposed between the elements.

Alternatively, the sealant can be attached to the perimeter of the insulating panel in such a way as to separate and isolate the insulating panel from the bases of the first and second glass elements. Preferably, at least a portion of the sealant is disposed between the insulating panel and at least one of the first and second glass elements. A currently preferred example of such an embodiment of the glazing system of the invention is depicted in FIG. 14. In particular, the sealant 1428 is disposed between the insulating panel 400 and the adjacent legs 1406, 1412 of the first and second glass elements 1402, 1408. As illustrated, the sealant 1428 is further disposed between the adjacent legs 1406, 1412 of the first and second glass elements 1402, 1408, as well as between the adjacent portions of one of the legs 1406, 1412 of the glass elements and the base 1404, 1410 of the other glass element. It will be appreciated by those of skill in the art that the insulating panel is preferably spaced away from the inside surfaces of the glass elements as shown in FIGS. 7–14. In this way, should any condensation from on an inside surface of either or both of the glass elements or on the outside surface of the insulating panel, the condensation can run down the surface, rather than collecting between the same.

The sealant can comprise any suitable material. Suitable sealants include, but are not limited to, silicone (e.g., silicone caulk, silicone adhesive, silicone gaskets), polymeric sealants (e.g., polyethylene gaskets), etc. Preferably, the sealant comprises silicone, more preferably a silicone gasket.

The insulated glazing system can be assembled in any appropriate order. For example, a first of the glass elements may be placed, the insulating panel disposed therebetween, and then the second of the glass elements placed. Alternately, the glass elements may be assembled together and the insulating panel then inserted in the cavity between the glass elements.

Figure 15:
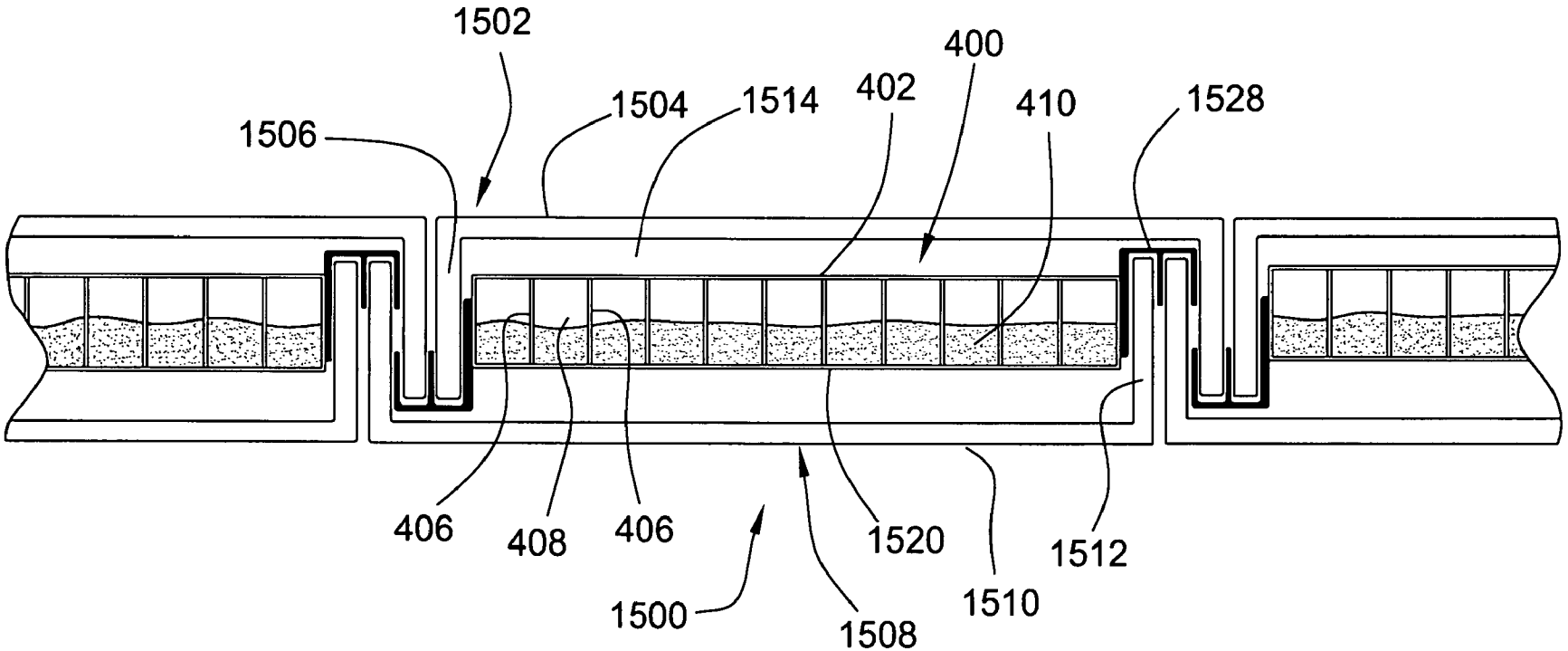
FIG. 15 is a sectional view of a modular insulated glazing system comprising an insulated glazing system similar to that depicted in FIG. 14.

An insulated glazing system according to teaching of the invention to be utilized in the construction of modular glazing systems is shown, for example, in FIG. 15. In such a modular arrangement, individual, partially assembled modules of glass elements with an enclosed insulating panel may be provided, the partially assembled modules of glass elements with insulating panels may then be assembled on site to form an extended glazed structure. In particular, the modular glazing system 1500 comprises a first U-shaped glass element 1502 comprising a base 1504 from which at least two legs 1506 extend and a second U-shaped glass element 1508 comprising a base 1510 from which at least two legs 1512 extend. The first and second glass elements 1502, 1508 are disposed to define a cavity 1514 therebetween. The glazing system 1500 further comprises an insulating panel 1516 disposed within the cavity 1514 formed by the first and second glass elements 1502, 1508. The insulating panel 1516 can comprise any of the insulating panels described above for the insulated glazing system of the invention. As depicted, the insulating panel 1516 comprises a first thermoplastic sheet 1518, a second thermoplastic sheet 1520, and at least two supporting members 1522. The supporting members 1522 are disposed between the first and second thermoplastic sheets 1518, 1520 in such a way to define at least one channel 1524 disposed between the first and second thermoplastic sheets 1518, 1520. In order to improve (i.e., lower) the thermal transmission of the glazing system 1500, the glazing system can further comprise hydrophobic aerogel particles 1526 disposed within at least one of the channels 1524 formed by the supporting members 1522. Preferably, at least a portion of the internal volume of one of the channels 1524 is filled with hydrophobic aerogel particles 1526. More preferably, substantially all of the internal volume of at least one of the channels 1524 is filled with hydrophobic aerogel particles 1526. Most preferably, at least a portion (or substantially all) of the internal volume of each of the channels 1524 is filled with hydrophobic aerogel particles 1526. The glazing system 1500 can further comprise at least one sealant 1528 disposed between the insulating panel 1516 and adjacent portions of the first and second glass elements 1502, 1508. In order to prevent contact between the glass elements, the sealant 1528 preferably is further disposed between adjacent portions of the first and second glass elements (e.g., between the legs 1506, 1512 of the first or second glass element 1502, 1508 and the base 1504 of the other glass element).

In summary, in order to minimize the thermal transmission of the glazing system, the insulating panel preferably is substantially coextensive with the length and the width of the cavity defined by the first and second glass elements (e.g., the length and width of the insulating panel are substantially the same as the length and width of the cavity). More preferably, the insulating panel is coextensive with the width of the cavity (e.g., the difference between the width of the cavity and the width of the panel is limited to the amount necessary to allow the panel to be inserted into the cavity and to accommodate any sealant disposed between the insulating panel and the adjacent surfaces of the glass elements forming the cavity). However, as noted above, the insulating panel preferably does not directly contact the first or second glass elements. Contact between the insulating panel and the glass elements can be prevented in any suitable manner, but a sealant preferably is disposed between the insulating panel and the first or second glass elements.

The hydrophobic aerogel particles that can be contained within the insulating panel of the glazing system can be any suitable hydrophobic aerogel particles. The hydrophobic aerogel particles can comprise organic aerogel particles, inorganic aerogel particles (e.g., metal oxide aerogel particles), or a mixture thereof. When the hydrophobic aerogel particles comprise organic aerogel particles, the organic aerogel particles preferably are selected from the group consisting of resorcinol-formaldehyde aerogel particles, melamine-formaldehyde aerogel particles, and combinations thereof. When the hydrophobic aerogel particles comprise inorganic aerogel particles, the inorganic aerogel particles preferably are metal oxide aerogel particles selected from the group consisting of silica aerogel particles, titania aerogel particles, alumina aerogel particles, and combinations thereof. Most preferably, the hydrophobic aerogel particles are silica aerogel particles.

The following examples further illustrate the invention but, of course, should not be construed as in any way limiting its scope.

EXAMPLE 1

This example demonstrates the improved U value (i.e., lower thermal transmission) exhibited by a glazing panel according to the invention relative to other glazing panels that do not comprise hydrophobic aerogel particles. The corrected U values for eleven similar translucent glazing panels were measured. Each of the glazing panels comprised a first polycarbonate sheet, a second polycarbonate sheet, and a plurality of supporting members disposed between the first and second polycarbonate sheets to define a plurality of channels between the first and second polycarbonate sheets.

Glazing Panels 1A (comparative) and 1B (invention) measured approximately 10 mm in thickness, and Glazing Panel 1B (invention) comprised hydrophobic aerogel particles disposed within the channels of the panel.

Glazing Panels 1C–1E measured approximately 16 mm in thickness and further comprised a third polycarbonate sheet disposed between and parallel to the first and second polycarbonate sheets, thereby forming two rows of channels disposed between the first and second polycarbonate sheets. Glazing Panel 1C (comparative) did not contain hydrophobic aerogel particles. Glazing Panel 1D (invention) contained hydrophobic aerogel particles disposed within both rows of channels disposed between the first and second polycarbonate sheets, and Glazing Panel 1E (invention) contained hydrophobic aerogel particles disposed within only one row of channels disposed between the first and second polycarbonate sheets.

Glazing Panels 1F–1H measured approximately 20 mm in thickness and further comprised a third polycarbonate sheet disposed between and parallel to the first and second polycarbonate sheets, thereby forming two rows of channels disposed between the first and second polycarbonate sheets. Glazing Panel 1F (comparative) did not contain hydrophobic aerogel particles. Glazing Panel 1G (invention) contained hydrophobic aerogel particles disposed within both rows of channels disposed between the first and second polycarbonate sheets, and Glazing Panel 1H (invention) contained hydrophobic aerogel particles disposed within only one row of channels disposed between the first and second polycarbonate sheets.

Glazing Panels 1I–1K measured approximately 25 mm in thickness and further comprised a third polycarbonate sheet disposed between and parallel to the first and second polycarbonate sheets, thereby forming two rows of channels disposed between the first and second polycarbonate sheets. Glazing Panel 1I (comparative) did not contain hydrophobic aerogel particles. Glazing Panel 1J (invention) contained hydrophobic aerogel particles disposed within both rows of channels disposed between the first and second polycarbonate sheets, and Glazing Panel 1K (invention) contained hydrophobic aerogel particles disposed within only one row of channels disposed between the first and second polycarbonate sheets.

The U value of each glazing system was measured in accordance with ASTM Standard C518-98, entitled "Standard Test Method for Steady-State Thermal Transmission Properties by Means of the Heat Flow Meter Apparatus." The U values obtained from these measurements were then corrected to account for the air film thermal resistance in accordance with the guidelines set forth in Chapter 30 of the 2001 ASHRAE Fundamentals Handbook. The corrected U values for Glazing Panels 1A –1K obtained by these measurements and corrections are set forth in Table 1 below.

TABLE 1

Thickness, Fill Particulars, Rows of Channels Filled, and Corrected U Values for Glazing Panels 1A–1K.

| Glazing Panel | Thickness (mm) | Fill | Rows of Channels Filled | Corrected U Value ($W/m^2K$) |
|---|---|---|---|---|
| 1A | 10 | — | — | 3.12 |
| 1B | 10 | Hydrophobic Aerogel Particles | One | 1.93 |
| 1C | 16 | — | — | 2.40 |
| 1D | 16 | Hydrophobic Aerogel Particles | Two | 1.31 |
| 1E | 16 | Hydrophobic Aerogel Particles | One | 1.70 |
| 1F | 20 | — | — | 1.89 |
| 1G | 20 | Hydrophobic Aerogel Particles | Two | 1.06 |
| 1H | 20 | Hydrophobic Aerogel Particles | One | 1.55 |
| 1I | 25 | — | — | 1.66 |
| 1J | 25 | Hydrophobic Aerogel Particles | Two | 0.89 |
| 1K | 25 | Hydrophobic Aerogel Particles | One | 1.39 |

The data set forth in Table 1 demonstrates that a glazing panel according to the invention exhibits a lower U value (i.e., lower thermal transmission) than a similar glazing panel that does not comprise hydrophobic aerogel particles. In particular, a glazing panel that does not comprise hydrophobic aerogel particles disposed within the channel(s) exhibits a corrected U value that is at least about 20% higher than a similar glazing panel that comprises hydrophobic aerogel particles disposed within the channel(s) or at least one row of the channels. Indeed, Glazing Panel 1I (comparative) exhibited a corrected U value that was approximately 85% greater than the corrected U value of Glazing Panel 1J (invention).

EXAMPLE 2

This example demonstrates the improved light diffusing properties (i.e., higher haze value) exhibited by a glazing panel according to the invention relative to other glazing panels that do not comprise hydrophobic aerogel particles. Six similar translucent glazing panels (Glazing Panels 2A–2F) were measured to determine the haze value of each panel. Each of the glazing panels comprised a first polycarbonate sheet, a second polycarbonate sheet, and a plurality of supporting members disposed between the first and second polycarbonate sheets to define a plurality of channels between the first and second polycarbonate sheets. Glazing Panels 2A (comparative) and 2D (invention) measured approximately 6 mm in thickness, Glazing Panels 2B (comparative) and 2E (invention) measured approximately 10 mm in thickness, and Glazing Panels 2C (comparative) and 2F (invention) measured approximately 20 mm in thickness. The channels of Glazing Panels 2D–2F (invention) were filled with hydrophobic aerogel particles. The channels of Glazing Panels 2A–2C (comparative) were not filled with hydrophobic aerogel particles (i.e., the channels merely contained air).

The haze value of each glazing panel was measured using an ULTRASCAN® XE spectrophotometer (available from HunterLab Associates, Reston, Va.). The results from these measurements are set forth in Table 2 below.

TABLE 2

Thickness, Fill Particulars, and Haze Values for Glazing Panels 2A–2F.

| Glazing Panel | Thickness (mm) | Fill | Haze Value (%) |
|---|---|---|---|
| 2A (comparative) | 6 | — | 48 |
| 2B (comparative) | 10 | — | 39 |
| 2C (comparative) | 20 | — | 31 |
| 2D (invention) | 6 | Hydrophobic Aerogel Particles | 89 |
| 2E (invention) | 10 | Hydrophobic Aerogel Particles | 94 |
| 2F (invention) | 20 | Hydrophobic Aerogel Particles | 97 |

The data set forth in Table 2 demonstrates that a glazing panel according to the invention exhibits a higher haze value than a similar glazing panel that does not contain hydrophobic aerogel particles. In particular, the haze value (measured in %) for a glazing panel according to the invention (i.e., Glazing Panels 2D–2F) is approximately two or more times greater than the haze value for a similar glazing panel that does not contain hydrophobic aerogel particles (i.e., Glazing Panels 2A–2C).

EXAMPLE 3

This example demonstrates the improved U value (i.e., lower thermal transmission) of a glazing system according to the invention relative to other glazing systems. The U values for four similar glazing systems were measured. Each of the four glazing systems (Glazing Systems 3A–3D) was constructed using two similar U-shaped glass elements. The glass elements comprised a base, which measured approximately 262 mm in length, and two legs perpendicularly extending from the base, which legs measured approximately 60 mm in length. The glass from which each element was constructed was approximately 7 mm thick. In order to prevent contact between the legs of one element and the inside surface of the base of the other element, a polymeric gasket was placed on the distal end of each leg. The two U-shaped glass elements were arranged so that the legs of each glass element projected from the base of the glass element toward the base of the other glass element, thereby defining a cavity between the two glass elements.

Glazing System 3A (comparative) did not comprise an insulation material disposed within the cavity formed by the glass elements.

Glazing System 3B (comparative) comprised a rigid insulation material measuring approximately 20 mm in thickness (Okapane® available from OkaLux GmbH, Marktheidenfeld-Altfeld, Germany) disposed within the cavity formed by the glass elements. The Okapane® rigid insulation material comprised a plurality of hollow poly(methyl methacrylate) tubes measuring approximately 20 mm in length and arranged in a substantially parallel relationship. Two glass fiber mats were adhered to the ends of the tubes, thereby forming a rigid insulation material in which the tubes were substantially perpendicular to the glass fiber mats.

Glazing System 3C (comparative) comprised another rigid insulation material measuring approximately 50 mm in thickness (Moniflex® available from Isoflex AB, Gustafs, Sweden) disposed within the cavity formed by the glass elements. The Moniflex® rigid insulation material comprised approximately 10 layers of corrugated cellulose acetate films, in which the pleats of each film were disposed in a substantially perpendicular direction to the pleats in the adjacent films. The individual layers of cellulose acetate film were glued together to form the rigid insulation material.

Glazing System 3D (invention) comprised a hydrophobic aerogel-filled insulated panel measuring approximately 20 mm in thickness. The insulated panel comprised a first polycarbonate sheet, a second polycarbonate sheet, and a plurality of supporting members disposed between the first and second polycarbonate sheets to define a plurality of channels between the first and second polycarbonate sheets. The hydrophobic aerogel particles were disposed within the channels formed by the supporting members.

The U value of each glazing system was measured in accordance with ASTM Standard C518-98. The U values obtained from such measurements were not corrected to account for air film thermal resistance. The results of these measurement are set forth in Table 3 below.

TABLE 3

Insulation Type and Thickness and U Values for Glazing Systems 3A–3D.

| Glazing System | Insulation | U Value ($W/m^2K$) |
|---|---|---|
| 3A (comparative) | — | 3.2 |
| 3B (comparative) | 20 mm Okapane ® | 1.6 |
| 3C (comparative) | 50 mm Moniflex ® | 1.4 |
| 3D (invention) | 20 mm Aerogel-filled Panel | 1.0 |

As evidenced by the data set forth in Table 3, a glazing system according to the invention exhibits a U value that is significantly lower than similar glazing systems that do not comprise an insulating panel according to the invention. In particular, a comparison of the U values for Glazing Systems 3A and 3D reveals that the U value for a glazing system that did not contain any insulation material disposed within the cavity formed by the glass elements (i.e., Glazing System 3A) exhibited a U value that was approximately 220% greater than the U value of a glazing system according to the invention (i.e., Glazing System 3D). A comparison of the U values for Glazing Systems 3B–3D further reveals that the U value for glazing systems comprising commercially available insulation materials disposed within the cavity formed by the glass elements exhibited U values that were approximately 60% (Glazing System 3B) and 40% (Glazing System 3C) greater that the U value of a glazing system according to the invention (i.e., Glazing System 3D).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A translucent glazing panel comprising:

(a) a thermoplastic panel comprising (i) an outer wall having an inner surface defining an internal channel, the internal channel having an internal volume, and (ii) at least one inner wall protruding from the inner surface into the internal channel, and (b) hydrophobic aerogel particles, the hydrophobic aerogel particles being disposed within the channel, wherein the translucent glazing panel has a haze value of about 50% or more.

2. The translucent glazing panel of claim 1, wherein the inner wall intersects the inner surface at at least two distinct points, the outer wall and inner wall defining at least a second internal channel, and the second internal channel has an internal volume.

3. The translucent glazing panel of claim 1, wherein the outer wall and the inner wall are unitarily formed of a thermoplastic resin.

4. The translucent glazing panel of claim 1, wherein the thermoplastic comprises a thermoplastic resin selected from the group consisting of polycarbonate, polyethylene, poly (methyl methacrylate), poly (vinyl chloride), and mixtures thereof.

5. The translucent glazing panel of claim 4, wherein the thermoplastic comprises polycarbonate.

6. The translucent glazing panel of claim 1, wherein substantially all of the internal volume of the channel is filled with hydrophobic aerogel particles.

7. The translucent glazing panel of claim 1, wherein the hydrophobic aerogel particles are organic aerogel particles selected from the group consisting of resorcinol-formaldehyde aerogel particles, melamine-formaldehyde aerogel particles, and combinations thereof.

8. The translucent glazing panel of claim 1, wherein the hydrophobic aerogel particles are metal oxide aerogel particles selected from the group consisting of silica aerogel particles, titania aerogel particles, alumina aerogel particles, and combinations thereof.

9. The translucent glazing panel of claim 8, wherein the hydrophobic aerogel particles are silica aerogel particles.

10. The translucent glazing panel of claim 1, wherein the thermoplastic glazing panel has a haze value of about 75% or more.

11. A translucent glazing panel comprising:

(a) a thermoplastic panel comprising (i) a first thermoplastic sheet, (ii) a second thermoplastic sheet, and (iii) two or more supporting members, the supporting members being disposed between the first and second thermoplastic sheets, and the supporting members defining at least one channel disposed between the first and second thermoplastic sheets, the channel having an internal volume, and (b) hydrophobic aerogel particles, the hydrophobic aerogel particles being disposed within the channel, wherein the translucent glazing panel has a haze value of about 50% or more.

12. The translucent glazing panel of claim 11, wherein the first thermoplastic sheet is substantially parallel to the second thermoplastic sheet.

13. The translucent glazing panel of claim 11, wherein the first thermoplastic sheet, the second thermoplastic sheet, and the supporting members are unitarily formed of a thermoplastic resin.

14. The translucent glazing panel of claim 11, wherein the thermoplastic panel further comprises a third thermoplastic sheet, the third thermoplastic sheet being disposed between the first and the second thermoplastic sheets, and the third thermoplastic sheet and the supporting members defining at least two rows of channels disposed between the first and second thermoplastic sheets.

15. The translucent glazing panel of claim 14, wherein the channels have an internal volume and at least a portion of the internal volume of each of the channels in one of the rows of channels is filled with hydrophobic aerogel particles.

16. The translucent glazing panel of claim 11, wherein the first and second thermoplastic sheets are separated by less than about 30 mm.

17. The translucent glazing panel of claim 11, wherein the thermoplastic comprises a thermoplastic resin selected from the group consisting of polycarbonate, polyethylene, poly (methyl methacrylate), poly (vinyl chloride), and mixtures thereof.

18. The translucent glazing panel of claim 17, wherein the thermoplastic comprises polycarbonate.

19. The translucent glazing panel of claim 11, wherein substantially all of the internal volume of the channel is filled with hydrophobic aerogel particles.

20. The translucent glazing panel of claim 11, wherein the hydrophobic aerogel particles are organic aerogel particles selected from the group consisting of resorcinol-formaldehyde aerogel particles, melamine-formaldehyde aerogel particles, and combinations thereof.

21. The translucent glazing panel of claim 11, wherein the hydrophobic aerogel particles are metal oxide aerogel particles selected from the group consisting of silica aerogel particles, titania aerogel particles, alumina aerogel particles, and combinations thereof.

22. The translucent glazing panel of claim 21, wherein the hydrophobic aerogel particles are silica aerogel particles.

23. The translucent glazing panel of claim 11, wherein the thermoplastic glazing panel has a haze value of about 75% or more.

24. An insulated glazing system comprising:

(a) a first U-shaped element comprising a base from which at least two legs extend, (b) a second U-shaped element comprising a base from which at least two legs extend, the first and second elements being disposed to define a cavity therebetween, (c) an insulating panel disposed within the cavity, the insulating panel comprising an outer wall defining an internal channel, the internal channel having an internal volume, and (d) hydrophobic aerogel particles, the hydrophobic aerogel particles being disposed within the internal channel, wherein the insulating panel has a haze value of about 50% or more.

25. The insulated glazing system of claim 24, wherein the outer wall of the insulating panel comprises a thermoplastic resin.

26. The insulated glazing system of claim 24, wherein the outer wall has an inner surface, and at least one inner wall protrudes from the inner surface into the internal channel.

27. The insulated glazing system of claim 26, wherein the inner wall intersects the inner surface at at least two distinct points, the outer wall and the inner wall defining at least a second Internal channel, and the second internal channel has an internal volume.

28. The insulated glazing system of claim 24, wherein the outer wail and the inner wall are unitarily formed of a thermoplastic resin.

29. The insulated glazing system of claim 28, wherein the thermoplastic resin is selected from the group consisting of polycarbonate, polyethylene, poly (methyl methacrylate), poly (vinyl chloride), and mixtures thereof.

30. The insulated glazing system of claim 29, wherein the thermoplastic resin comprises polycarbonate.

31. The insulated glazing system of claim 24, wherein substantially all of the internal volume of the internal channel is filled with hydrophobic aerogel particles.

32. The insulated glazing system of claim 24, wherein the hydrophobic aerogel particles are organic aerogel particles selected from the group consisting of resorcinol-formaldehyde aerogel particles, melamine-formaldehyde aerogel particles, and combinations thereof.

33. The insulated glazing system of claim 24, wherein the hydrophobic aerogel particles are metal oxide aerogel particles selected from the group consisting of silica aerogel particles, titania aerogel particles, alumina aerogel particles, and combinations thereof.

34. The insulated glazing system of claim 33, wherein the hydrophobic aerogel particles are silica aerogel particles.

35. An insulated glazing system comprising:

(a) a first U-shaped element comprising a base from which at least two legs extend, (b) a second U-shaped element comprising a base from which at least two legs extend, the first and second elements being disposed to define a cavity therebetween, and (c) an insulating panel disposed within the cavity, the insulating panel comprising (i) an outer wall having an inner surface defining an internal channel, the internal channel having an internal volume, and (ii) at least one inner wall protruding from the inner surface into the internal channel, the outer wall and inner wall being unitarily formed of a thermoplastic resin, wherein the insulated glazing system further comprises hydrophobic aerogel particles, the hydrophobic aerogel particles being disposed within the internal channel, and wherein the insulating panel has a haze value of about 50% or more.

36. The insulated glazing system of claim 35, wherein substantially all of the internal volume of the internal channel is filled with hydrophobic aerogel particles.

37. The insulated glazing system of claim 35, wherein the hydrophobic aerogel particles are organic aerogel particles selected from the group consisting of resorcinol-formaldehyde aerogel particles, melamine-formaldehyde aerogel particles, and combinations thereof.

38. The insulated glazing system of claim 35, wherein the hydrophobic aerogel particles are metal oxide aerogel particles selected from the group consisting of silica aerogel particles, titania aerogel particles, alumina aerogel particles, and combinations thereof.

39. The insulated glazing system of claim 38, wherein the hydrophobic aerogel particles are silica aerogel particles.

40. An insulated glazing system comprising:

(a) a first U-shaped element comprising a base from which at least two legs extend, (b) a second U-shaped element comprising a base from which at least two legs extend, the first and second element being disposed to define a cavity therebetween, and (c) an insulating panel disposed within the cavity, the insulating panel comprising (i) a first thermoplastic sheet, (ii) a second thermoplastic sheet, the first and second thermoplastic sheets being substantially parallel to each other, and (iii) at least two supporting members, the supporting members being disposed between the first and second thermoplastic sheets, and the supporting members defining at least one channel disposed between the first and second thermoplastic sheets, wherein the insulated glazing system further comprises hydrophobic aerogel particles, the hydrophobic aerogel particles being disposed within the channel, and wherein the insulating panel has a haze value of about 50% or more.

41. The insulated glazing system of claim 40, wherein substantially all of the internal volume of the internal channel is filled with hydrophobic aerogel particles.

42. The insulated glazing system of claim 40, wherein the hydrophobic aerogel particles are organic aerogel particles selected from the group consisting of resorcinol-formaldehyde aerogel particles, melamine-formaldehyde aerogel particles, and combinations thereof.

43. The insulated glazing system of claim 40, wherein the hydrophobic aerogel particles are metal oxide aerogel particles selected from the group consisting of silica aerogel particles, titania aerogel particles, alumina aerogel particles, and combinations thereof.

44. The insulated glazing system of claim 43, wherein the hydrophobic aerogel particles are silica aerogel particles.

45. The insulated glazing system of claim 35, wherein the inner wall intersects the inner surface at at least two distinct points, the outer wall and the inner wall defining at least a second internal channel, and the second internal channel has an internal volume.

46. The insulated glazing system of claim 40, wherein the first thermoplastic sheet, the second thermoplastic sheet, and the supporting members are unitarily formed of a thermoplastic resin.

47. The insulated glazing system of claim 46, wherein the thermoplastic resin is selected from the group consisting of polycarbonate, polyethylene, poly (methyl methacrylate), poly (vinyl chloride), and mixtures thereof.

48. The insulated glazing system of claim 47, wherein the thermoplastic resin comprises polycarbonate.

49. The insulated glazing system of claim 40, wherein the insulated glazing system further comprises at least one sealant disposed between adjacent portions of the first and second elements.

50. The insulated glazing system of claim 49, wherein the sealant comprises silicone.

51. The insulated glazing system of claim 50, wherein the sealant comprises a silicone gasket.

52. The insulated glazing system of claim 49, wherein the insulating panel has a perimeter, and the sealant is attached to at least a portion of the perimeter of the insulating panel.

53. The insulated glazing system of claim 49, wherein at least a portion of the sealant is disposed between the insulating panel and at least one of the first and second elements.

54. The insulated glazing system of claim 40, wherein the cavity defined by the first and second elements has a length and a width, and the insulating panel is substantially coextensive with the length and the width of the cavity.

55. The insulated glazing system of claim 40, wherein the insulating panel is coextensive with the width of the cavity.

56. The insulated glazing system of claim 40, wherein the insulating panel does not directly contact the first or second elements.

57. The insulated glazing system of claim 40, wherein the base of the first element is substantially parallel to the base of the second element.

58. The insulated glazing system of claim 40, wherein the legs of the first element are substantially parallel to the legs of the second element.

* * * * *